US008321206B2

(12) United States Patent
Goodwin et al.

(10) Patent No.: US 8,321,206 B2
(45) Date of Patent: Nov. 27, 2012

(54) TRANSIENT DETECTION AND MODIFICATION IN AUDIO SIGNALS

(75) Inventors: Michael Goodwin, Scotts Valley, CA (US); Carlos Avendano, Campbell, CA (US); Martin Wolters, Nuremberg (DE); Ramkumar Sridharan, Capitola, CA (US)

(73) Assignee: Creative Technology Ltd, Singapore (SG)

( * ) Notice: Subject to any disclaimer, the term of this patent is extended or adjusted under 35 U.S.C. 154(b) by 1276 days.

(21) Appl. No.: 12/012,251

(22) Filed: Jan. 31, 2008

(65) Prior Publication Data

US 2008/0212795 A1 Sep. 4, 2008

Related U.S. Application Data

(63) Continuation of application No. 10/606,196, filed on Jun. 24, 2003, now Pat. No. 7,353,169.

(51) Int. Cl.
*G10L 11/00* (2006.01)

(52) U.S. Cl. ..... 704/200

(58) Field of Classification Search ..... None
See application file for complete search history.

(56) References Cited

U.S. PATENT DOCUMENTS

| | | | | |
|---|---|---|---|---|
| 6,091,013 | A * | 7/2000 | Waller et al. | 84/663 |
| 6,307,141 | B1 * | 10/2001 | Laroche et al. | 84/636 |
| 6,570,991 | B1 * | 5/2003 | Scheirer et al. | 381/110 |
| 7,957,539 | B2 * | 6/2011 | Packard | 381/61 |
| 2003/0221544 | A1 * | 12/2003 | Weissflog | 84/667 |
| 2004/0044525 | A1 * | 3/2004 | Vinton et al. | 704/224 |
| 2007/0137464 | A1 * | 6/2007 | Moulios et al. | 84/612 |

* cited by examiner

*Primary Examiner* — Jakieda Jackson
(74) *Attorney, Agent, or Firm* — Creative Technology Ltd

(57) ABSTRACT

A system and method are disclosed for transient detection and modification in audio signals. Digital signal processing techniques are used to detect transients and modify an audio signal to enhance or suppress such transients, as desired. A transient audio event is detected in a first portion of the audio signal. A graded response to the detected transient audio event is determined. The first portion of the audio signal is modified in accordance with the graded response. The extent of enhancement or suppression (as applicable) may be determined at least in part by a measure of the significance or magnitude of the transient.

19 Claims, 14 Drawing Sheets

TRANSIENT DETECTION AND MODIFICATION IN AUDIO SIGNALS

CROSS REFERENCE TO RELATED APPLICATIONS

This application is a continuation of U.S. patent application Ser. No. 10/606,196, entitled TRANSIENT DETECTION AND MODIFICATION IN AUDIO SIGNALS filed Jun. 24, 2003 now U.S. Pat. No. 7,353,169 which is incorporated herein by reference for all purposes.

This application is related to co-pending U.S. patent application Ser. No. 10/606,373 entitled "Enhancing Audio Signals by Nonlinear Spectral Operations," filed Jun. 24, 2003, which is incorporated herein by reference for all purposes.

FIELD OF THE INVENTION

The present invention relates generally to digital signal processing. More specifically, transient detection and modification in audio signals is disclosed.

BACKGROUND OF THE INVENTION

Audio signals or streams typically may be rendered to a listener, such as by using a speaker to provide an audible rendering of the audio signal or stream. An audio signal or stream so rendered may have one or more characteristics that may be perceived and, in some cases, identified and/or described by a discerning listener. For example, a listener may be able to detect how sharply or clearly transient audio events, such as a drumstick hitting a drum, are rendered.

One approach to ensuring a desired level of performance with respect to such a characteristic is to purchase "high end" (i.e., relatively very expensive) audio equipment that renders audio data in a manner that achieves the desired effect. For example, some audiophiles report that certain high-end equipment renders audio signals and/or data streams in a way that emphasizes or enhances transient audio events to a greater extent than less expensive audio equipment.

Different listeners may have different preferences and/or tastes with respect to such identifiable perceptual characteristics. For example, one listener may prefer that transient audio events, such as drum hits, be enhanced or otherwise emphasized, whereas another might instead prefer that such transient events be suppressed to some extent or otherwise de-emphasized. In addition, an individual listener may prefer that such transients be enhanced for certain types of audio data (e.g., rock music), and suppressed or softened to a degree for other types (e.g., classical music or non-music recordings).

Therefore, there is a need for a way to emphasize or de-emphasize, as desired, transient audio events (hereinafter "transients") in an audio signal or stream. In addition, there is a need to provide for user control over such emphasis or de-emphasis, specifically to enable an individual user to control the extent of emphasis or de-emphasis of transients in accordance with the user's taste or preference, generally and/or with respect to the particular type of audio data being rendered. An unpleasant listening experience including annoying "pumping" of the audio or other undesirable effects can result from strongly emphasizing transients that exceed a certain threshold and completely ignoring all those that fall below that threshold, so there is a need to provide a way for transients to be emphasized or de-emphasized, as desired, in a way that will not result in an unpleasant listening experience. There is a need to provide all of the above in a way that is accessible to consumers and other users of less expensive audio equipment.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION

It should be appreciated that the present invention can be implemented in numerous ways, including as a process, an apparatus, a system, or a computer-readable medium such as a computer-readable storage medium or a computer network wherein program instructions are sent over optical or electronic communication links. It should be noted that except as specifically noted the order of the steps of disclosed processes may be altered within the scope of the invention.

A detailed description of one or more preferred embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

Digital signal processing techniques may be used to modify an audio signal or stream to render a modified audio output having different perceptual characteristics than the original, unmodified signal or stream. In one embodiment, such techniques are used to detect transients and modify the audio signal or stream (hereinafter referred to collectively by the term "audio signal") to enhance or suppress such transients, as desired. In one embodiment, as described more fully below, transients are detected and the signal modified in accordance with a graded response, with the extent of enhancement or suppression (as applicable) being determined in one embodiment at least in part by a measure of the significance or magnitude of the transient.

Figure 1:
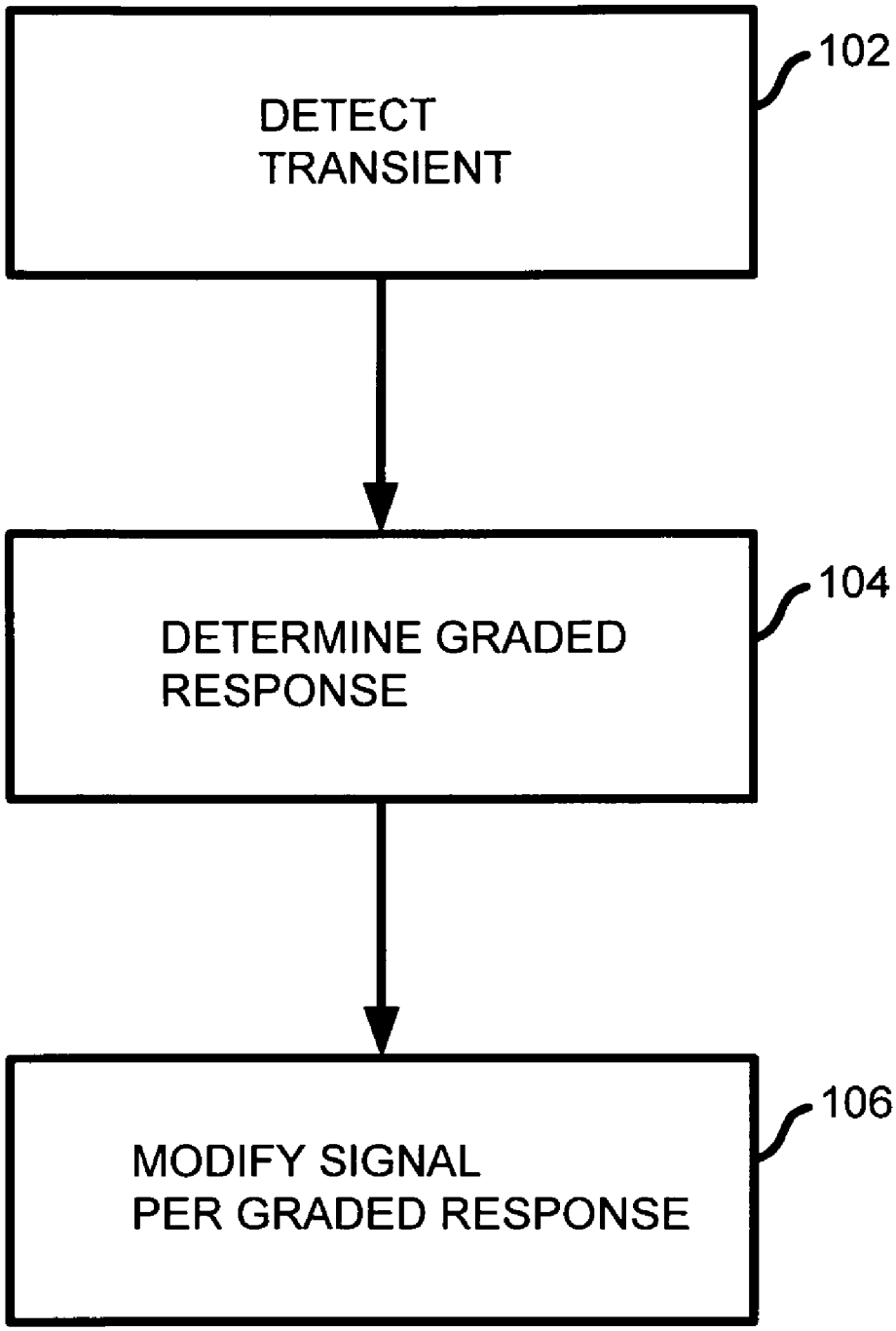
FIG. 1 is a flowchart illustrating a process used in one embodiment to detect and modify transients in audio signals.

FIG. 1 is a flowchart illustrating a process used in one embodiment to detect and modify transients in audio signals. In step 102, a transient is detected in the audio signal. In one embodiment, as described more fully below, step 102 comprises monitoring spectral flux to identify portions of the audio signal characterized by a high degree of spectral change, such as typically may be present when a transient audio event occurs. Such transients typically are characterized by a significant increase in spectral content across a broad spectrum of frequencies (or a significant increase in one range of frequencies and significant decrease in another range; or any significant change in spectral content that may be associated with a transient event), and as such may be detected in one embodiment by monitoring the extent to which spectral magnitude has changed from one frame of audio data to the next. In step 104 of the process shown in FIG. 1, a graded response is determined. As used herein, the term "graded response" is used to indicate a response to a transient audio event that is determined at least in part by some measure of the magnitude and/or significance of a detected transient audio event. Such an approach stands in contrast, for example, to one in which a solely binary determination is made as to whether or not a transient audio event has been detected, and the signal modified in a single prescribed manner if such an event is present and not modified at all if such an event is not present. In step 106, the portion of the audio signal in which the transient is detected in step 102 is modified in accordance with the graded response determined in step 104, as explained in more detail below.

Figure 2:
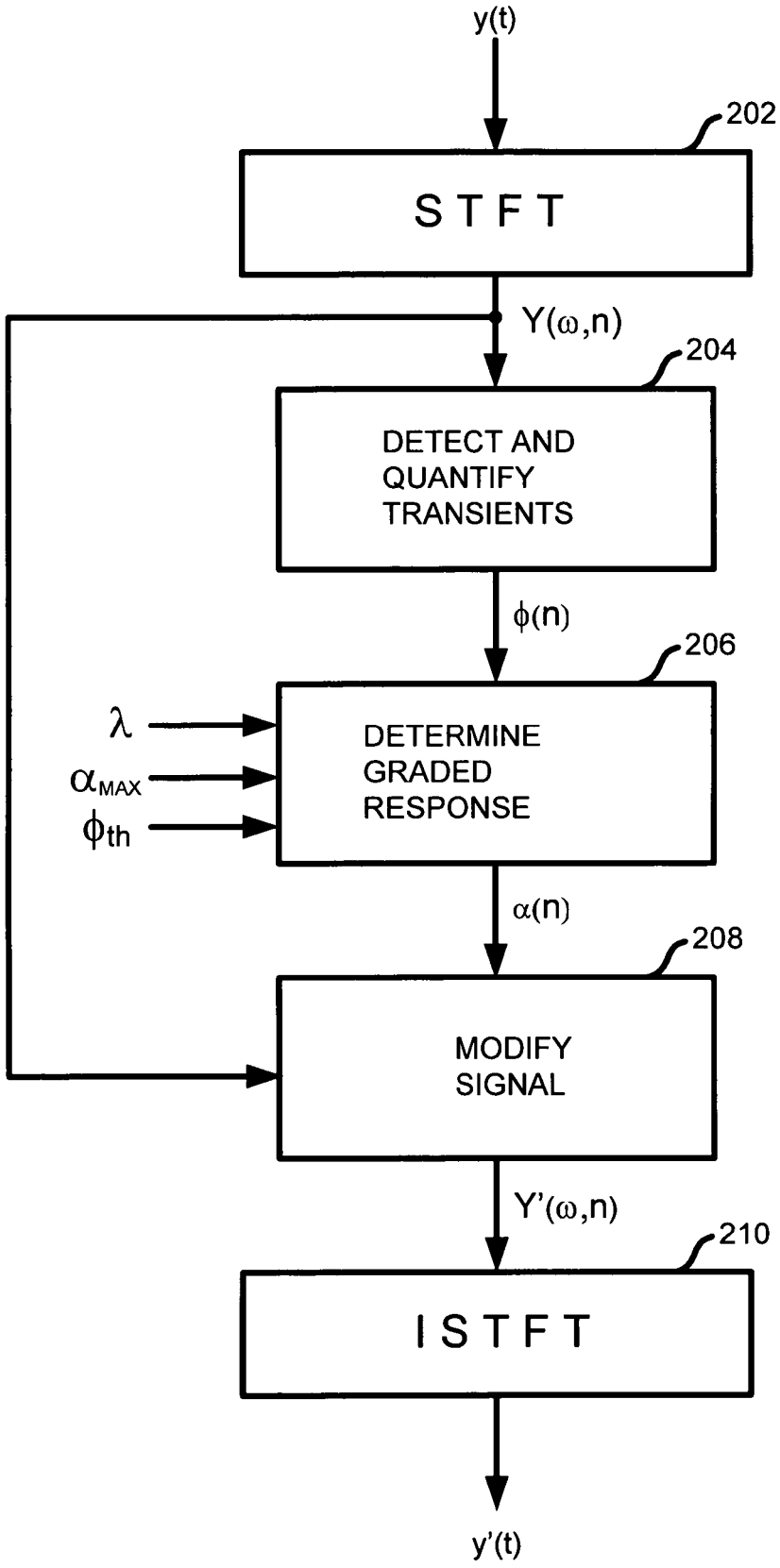
FIG. 2 is a block diagram of a system provided in one embodiment for detecting and modifying transient audio events in an audio signal.

FIG. 2 is a block diagram of a system provided in one embodiment for detecting and modifying transient audio events in an audio signal. As shown in FIG. 2, an input audio signal y(t) is input to a short-time Fourier transform (STFT) computation block 202 which is configured to calculate the STFT of the incoming audio signal y(t). In one embodiment, the incoming audio signal y(t) may comprise a plurality of channels, e.g., a left channel $y_L(t)$ and a right channel $y_R(t)$. The STFT is well known to those of skill in the art, and in short comprises calculating the Fourier transform for successive frames of the incoming audio signal y(t) in order, for example, to analyze how the frequency-domain representation of successive portions of the incoming audio signal changes over time. For example, for an incoming audio signal with a single transient event, one would expect that the STFT calculated for a time window including the portion of the incoming audio signal containing the transient audio event to reflect a high level of spectral content across a broad range of frequencies relative to the STFT calculated for time windows of the incoming audio signal that do not include the transient audio event. While the embodiment shown in FIG. 2 uses the STFT to detect transient events, any suitable subband filter bank may be used to obtain the results needed to detect and quantify transient audio events.

In one embodiment, the STFT computation block 202 is configured to calculate the STFT for successive frames that may overlap in the time domain. In one embodiment, each frame comprises a plurality of samples. In one embodiment, a window is applied to the data frame prior to calculating the STFT. In one embodiment, the window is selected so as to achieve better frequency resolution. In one embodiment, the window has the shape of a bell curve. In one embodiment, the window selected to achieve the desired frequency resolution does not overlap add to one. In one such embodiment, when the successive frames are recombined after modification, as described more fully below, a normalization window is applied as needed to adjust for the fact that the window used does not overlap add to one. In one alternative embodiment, a window that overlap adds to one is used, and in such an alternative embodiment a normalization window is not needed.

As shown in FIG. 2, the output of the STFT block 202 is a series of frequency-domain representations $Y(\omega, n)$, each frequency-domain representation $Y(\omega, n)$ corresponding to a frame "n" in the time domain of the incoming signal y(t). In one embodiment, if the incoming time-domain audio signal y(t) comprises multiple channels, the system shown in FIG. 2 may be configured to calculate using block 202 (or a plurality of blocks 202), a series of frequency-domain representations $Y_i(\omega, n)$ for each channel, where the subscript "i" indicates the channel. The frequency-domain signal $Y(\omega, n)$ is provided to a block 204 configured to detect and quantify transient audio events. In one embodiment, as described more fully below, the block 204 is configured to detect and quantify transients by calculating the magnitude of the signal $Y(\omega, n)$ for each successive frame, calculating a difference in magnitude between a current frame and a previous frame, and using the difference value to calculate a normalized spectral flux, the spectral flux comprising a measure of the degree of change in spectral content between successive frames or windows of data. In one embodiment, as shown in FIG. 2, the block 204 is configured to provide as output a series of spectral flux values $\Phi(n)$, where "n" indicates the frame to which a particular spectral flux value applies. In one embodiment, the spectral flux values $\Phi(n)$ comprise normalized spectral flux values.

As shown in FIG. 2, the spectral flux values $\Phi(n)$ are provided by block 204 to block 206, which is configured to determine a graded response to successive portions of the incoming audio signal y(t) based at least in part on the magnitude of the corresponding spectral flux $\Phi(n)$. As shown in FIG. 2, other inputs provided to the block 206 include in one embodiment a slope parameter "$\lambda$", a maximum modification factor "$\alpha_{MAX}$" and a normalized spectral flux threshold value "$\Phi_{th}$" In one embodiment, the values of one or more of the slope parameter $\lambda$, maximum modification factor $\alpha_{MAX}$, and normalized spectral flux threshold value $\Phi_{th}$ may be varied. In one embodiment, the value of one or more of the slope parameter $\lambda$, maximum modification factor $\alpha_{MAX}$, and normalized spectral flux threshold value $\Phi_{th}$ may be varied by a user by actuating a user control provided via a user interface, as described more fully below. The output of the block 206 comprises a modification factor $\alpha(n)$, which is provided to signal modification block 208. As shown in FIG. 2, the frequency-domain representations $Y(\omega, n)$ provided as output by STFT block 202 also are provided as input to signal modification block 208. As noted above, the frequency-domain representations $Y(\omega, n)$ provided to signal modification block 208 may comprise multiple channels. The signal modification block 208 is configured to use these inputs, as explained more fully below, to provide as output a modified frequency-domain representation $Y'(\omega, n)$ for successive frames in the time domain of the unmodified incoming audio signal. The modified frequency-domain representation $Y'(\omega, n)$ for each frame is provided as input to an inverse STFT block 210. The inverse STFT block 210 is configured to perform the inverse short-time Fourier transform (ISTFT) on the incoming modified frequency-domain representation $Y'(\omega, n)$ of the audio signal and provide as output a modified time-domain signal y'(t), which has been modified in comparison to the incoming signal y(t) to either enhance or suppress transient audio events, as desired, in accordance with the processing performed by blocks 204, 206 and 208 of the system illustrated in FIG. 2. As noted above, in an embodiment in which STFT computation block 202 is configured to apply a window to each data frame prior to calculating the STFT, the inverse STFT block 210 may be configured to apply a normalization window, as needed, if the window used does not overlap add to one. In one embodiment, inverse STFT block 210 is configured to overlap-add the inverse STFT output for successive frames to reconstruct a continuous modified time-domain signal.

Figure 3:
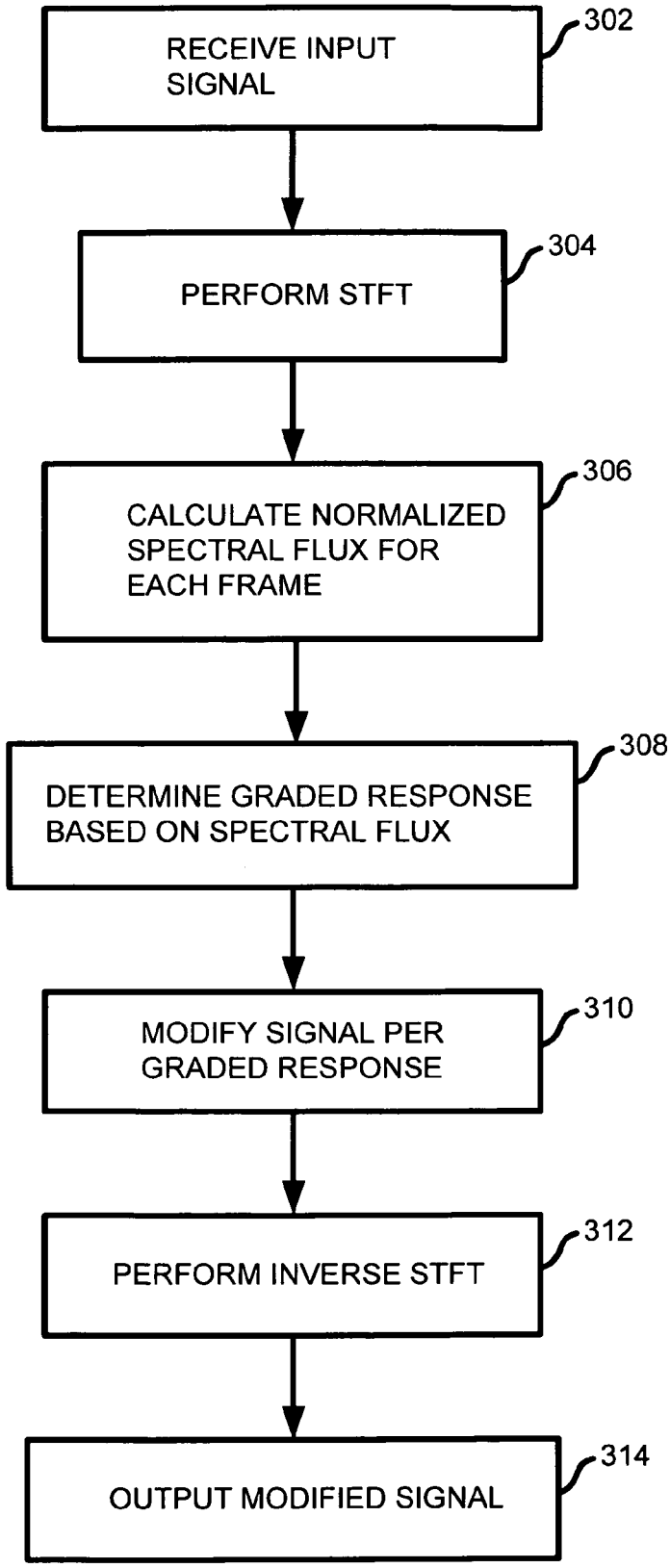
FIG. 3 is a flowchart illustrating a method used in one embodiment to detect and modify transient audio events in an audio signal, such as may be implemented in one embodiment of the system shown in FIG. 2.

FIG. 3 is a flowchart illustrating a method used in one embodiment to detect and modify transient audio events in an audio signal, such as may be implemented in one embodiment of the system shown in FIG. 2. The process begins in step 302 in which an input audio signal is received. In step 304 the STFT of the input audio signal is performed by applying a Fourier transform to successive frames of the time-domain input data, thereby generating successive frames of frequency-domain data. In step 306 a normalized spectral flux is calculated for each successive frame. In one embodiment, as described more fully below, the normalized spectral flux is defined so as to provide a measure of the degree of change in spectral content from one frame of audio data to the next, so that the spectral flux value may provide an indication of the extent to which a transient audio event may be present in the portion of the audio signal with which the normalized spectral flux value is associated. In step 308 of the process shown in FIG. 3 a graded response is determined based on the spectral flux value determined in step 306. In one embodiment, a modification factor is calculated, as discussed above in connection with block 206 of the system shown in FIG. 2, based at least in part on the normalized spectral flux value determined in step 306. In step 310, the input audio signal is modified in accordance with the graded response determined in step 308. In step 312, the inverse STFT is performed on the modified signal. In step 314 the modified signal, now once again in the time domain, is provided as output. It will be apparent to those of skill in the art that the process shown in FIG. 3 is a continuous one in which, as the input audio signal is received in step 302, successive frames or time windows of that signal are processed as set forth in steps 304 to 314 of FIG. 3. In one embodiment, the steps of the process shown in FIG. 3 are performed continuously as an input audio signal is received. In one embodiment the input audio signal may be received from an external source, such as a radio or television broadcast, a broadcast or audio data stream received via a network, or through playback from any number of memory or storage devices or media, such as from a compact disc, a computer hard drive, an MP3 file, or any other memory or storage device suitable for storing audio data in any format.

Figure 4A:
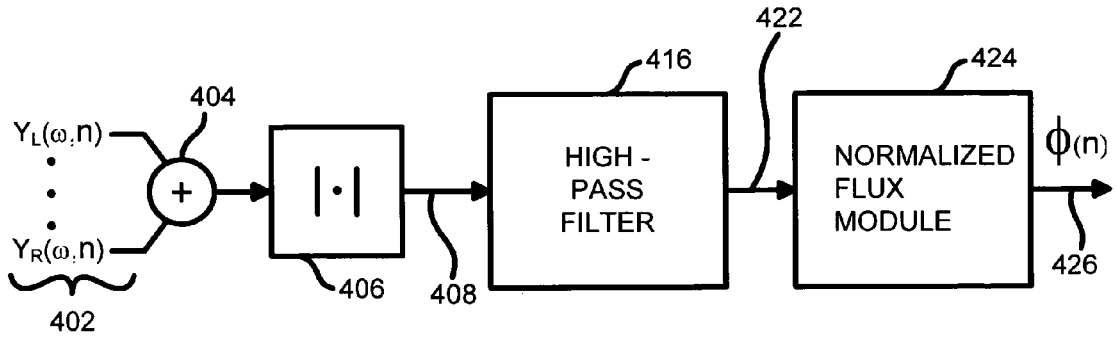
FIG. 4A is a block diagram of a system used in one embodiment to calculate a normalized spectral flux $\Phi(n)$ for an audio signal, such as in step 306 of the process shown in FIG. 3.

FIG. 4A is a block diagram of a system used in one embodiment to calculate a normalized spectral flux $\Phi(n)$ for an audio signal, such as in step 306 of the process shown in FIG. 3. FIG. 4A shows an incoming set of STFT results $Y(\omega, n)$ identified in FIG. 4A by the reference numeral 402. As shown in FIG. 4A, the incoming STFT results $Y(\omega, n)$ comprise multiple channels, of which a left and a right channel of information are shown in FIG. 4A. While only a left and a right channel are represented in FIG. 4A, it is understood that the incoming signal may comprise only a single channel or more than two channels. As shown in FIG. 4A, the channels comprising the multi-channel incoming signal $Y(\omega, n)$ are combined in a block 404 and provided as a combined input to a magnitude determination block 406. The magnitude determination block 406 in one embodiment is configured to determine the spectral magnitude $S(\omega, n)$ of the incoming signal $Y(\omega, n)$.

The magnitude determination block 406 provides the magnitude values $S(\omega, n)$ as output to the line 408, which provides the magnitude values to a high-pass filter 416. In one embodiment, the high-pass filter 416 is configured to detect differences in the incoming magnitude values $S(\omega, n)$ for successive frames, such as may be associated with a transient audio event. In one embodiment, described more fully below with respect to FIG. 4B, the high-pass filter 416 is configured to calculate a first order difference between the magnitude values $S(\omega, n)$ for successive frames. The output of the high-pass filter 416 is provided via a line 422 to a normalized flux module 424. The block 424 is configured in one embodiment to use the output of high-pass filter 416 to calculate a normalized spectral flux ($\omega(n)$ for each successive frame "n", and to provide the normalized spectral flux values $\Phi(n)$ as output on line 426. In one embodiment, the un-normalized spectral flux for any given frame "n" is defined as the sum of the square root of the output of high-pass filter 416 for that frame across the frequency spectrum. In one embodiment, the spectral flux is normalized by dividing the spectral flux by a normalization factor, as described more fully below in connection with FIG. 6. In one embodiment, as described more fully below, the normalization factor corresponds to the maximum flux calculated up to that point in time for any frame of the audio signal. In one embodiment, the value of the normalization factor may decay (decrease) over time as part of a "forgetting" process, as described more fully below in connection with FIG. 6.

Figure 4B:
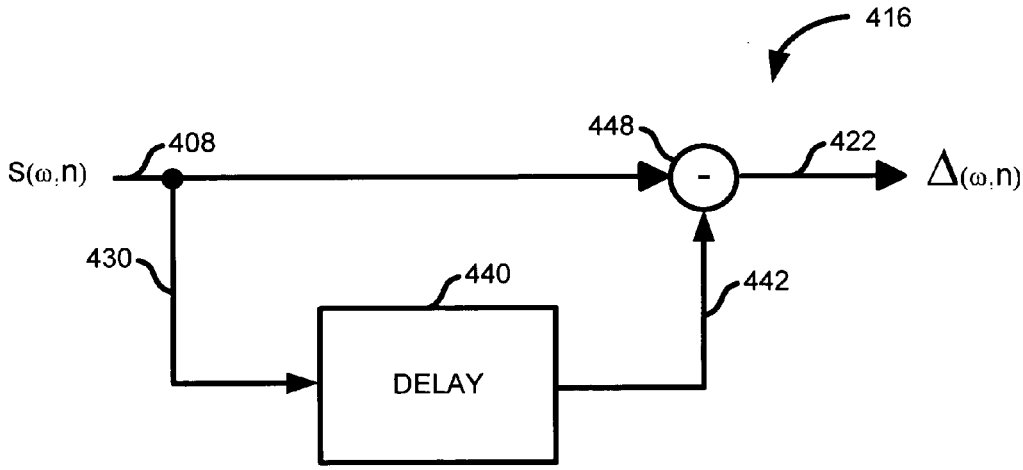
FIG. 4B illustrates a high-pass filter used in one embodiment to detect major spectral changes.

FIG. 4B illustrates a high-pass filter used in one embodiment to detect major spectral changes. The high-pass filter 416 comprises input line 408 of FIG. 4A, on which the magnitude values S(ω, n) for successive frames are received. The magnitude values are provided to a difference determination block 448. The magnitude values also are provided via line 430 to delay 440. The output of delay 440 is provided via line 442 to the difference determination block 448. The delay 440 is configured such that at any given time the magnitude value provided on line 442 corresponds to the spectral magnitude value for the frame preceding the frame associated with the magnitude value being provided to the difference determination block 448 via line 408. As a result, the magnitude value on line 408 may be represented by the expression S(ω, n) and the value provided on line 442 may be represented by the notation S(ω, n−1), such that the output provided by the difference determination block 448 to line 422 is in one embodiment the difference between the spectral magnitude for the frame currently being analyzed and the immediately preceding frame, such that the difference value provided on line 422 represents the change in spectral magnitude between successive frames, i.e., S(ω, n)−S(ω, n−1), where "n" corresponds to a frame currently being analyzed and "n−1" corresponds to the immediately preceding frame. The notation Δ(ω, n) is used in FIG. 4B and below to refer to the output of high-pass filter 416, and is understood to represent the output of said high-pass filter including in embodiments in which the filter 416 outputs something other than the first order difference between the current and immediately previous frames.

Figure 5:
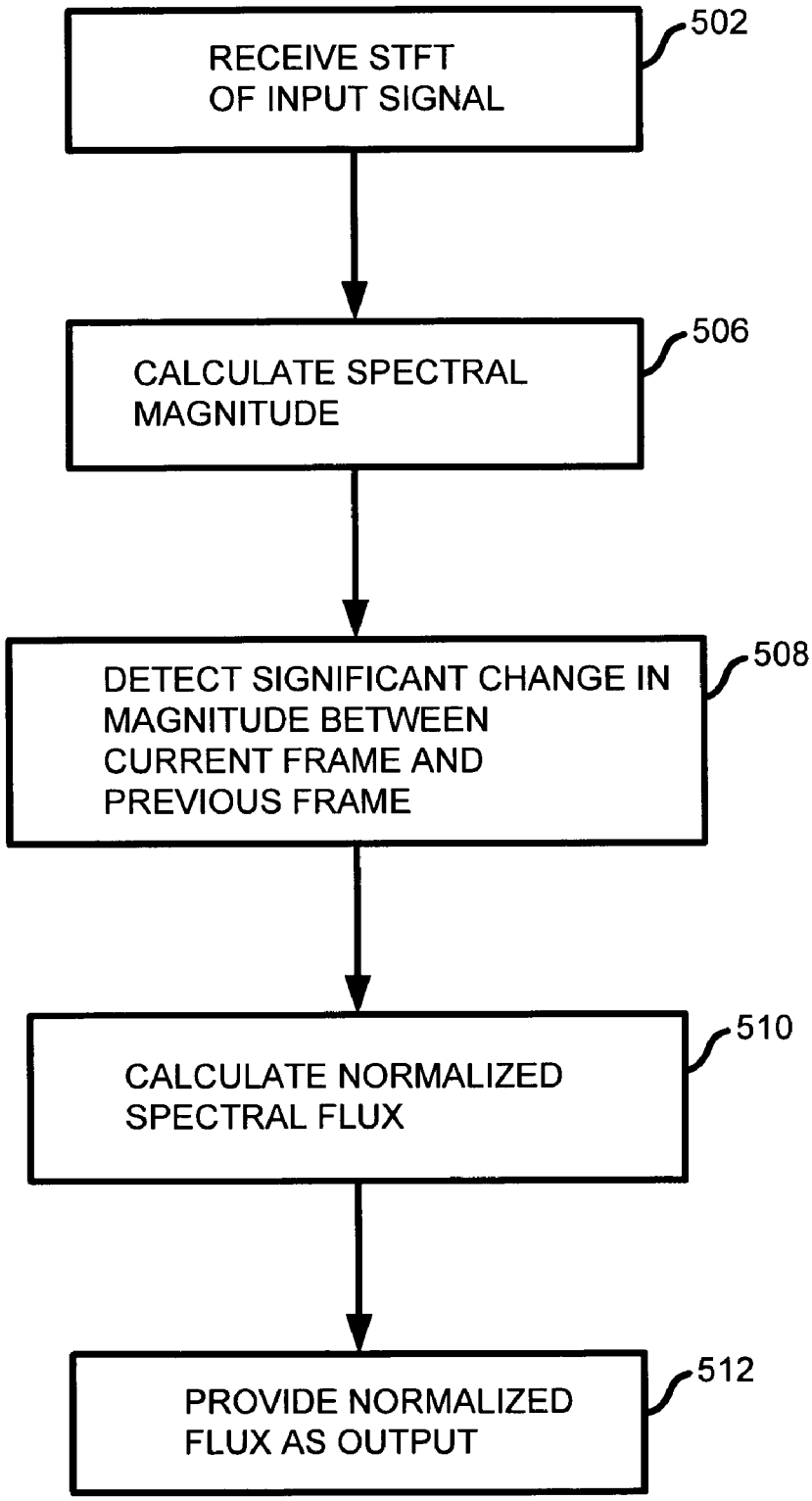
FIG. 5 is a flowchart illustrating a process used in one embodiment to detect and quantify transients, such as may be implemented by block 204 of the system shown in FIG. 2 and/or by the system shown in the block diagram of FIG. 4A.

FIG. 5 is a flowchart illustrating a process used in one embodiment to detect and quantify transients, such as may be implemented by block 204 of the system shown in FIG. 2 and/or by the system shown in the block diagram of FIG. 4A. The process shown in FIG. 5 begins in step 502 in which the STFT results for an input audio signal are received. In one embodiment, step 502 corresponds to the receipt of STFT results Y(ω, n), such as the incoming values 402 shown in FIG. 4A. In one embodiment, all channels of the received incoming signal are combined, as shown in FIG. 4A, to form a single combined signal for which the spectral flux is determined. In one alternative embodiment, the channels of the incoming signal (if multi-channel) are not combined, and the spectral flux is calculated on a per channel basis. In step 506 the spectral magnitude of successive frames is calculated as is described above in connection with block 406 of FIG. 4A. In step 508, a significant change in spectral magnitude is detected, as described above in connection with high-pass filter 416 of FIG. 4A. In one embodiment, step 508 comprises computing the difference in spectral magnitude between a current frame and the immediately previous frame, such as described above in connection with FIG. 4B. In step 510, the normalized spectral flux Φ(n) is calculated, such as described above in connection with block 424 of the system shown in FIG. 4A and described more fully below in connection with FIG. 6. In step 512, the normalized spectral flux Φ(n) is provided as output.

Figure 6:
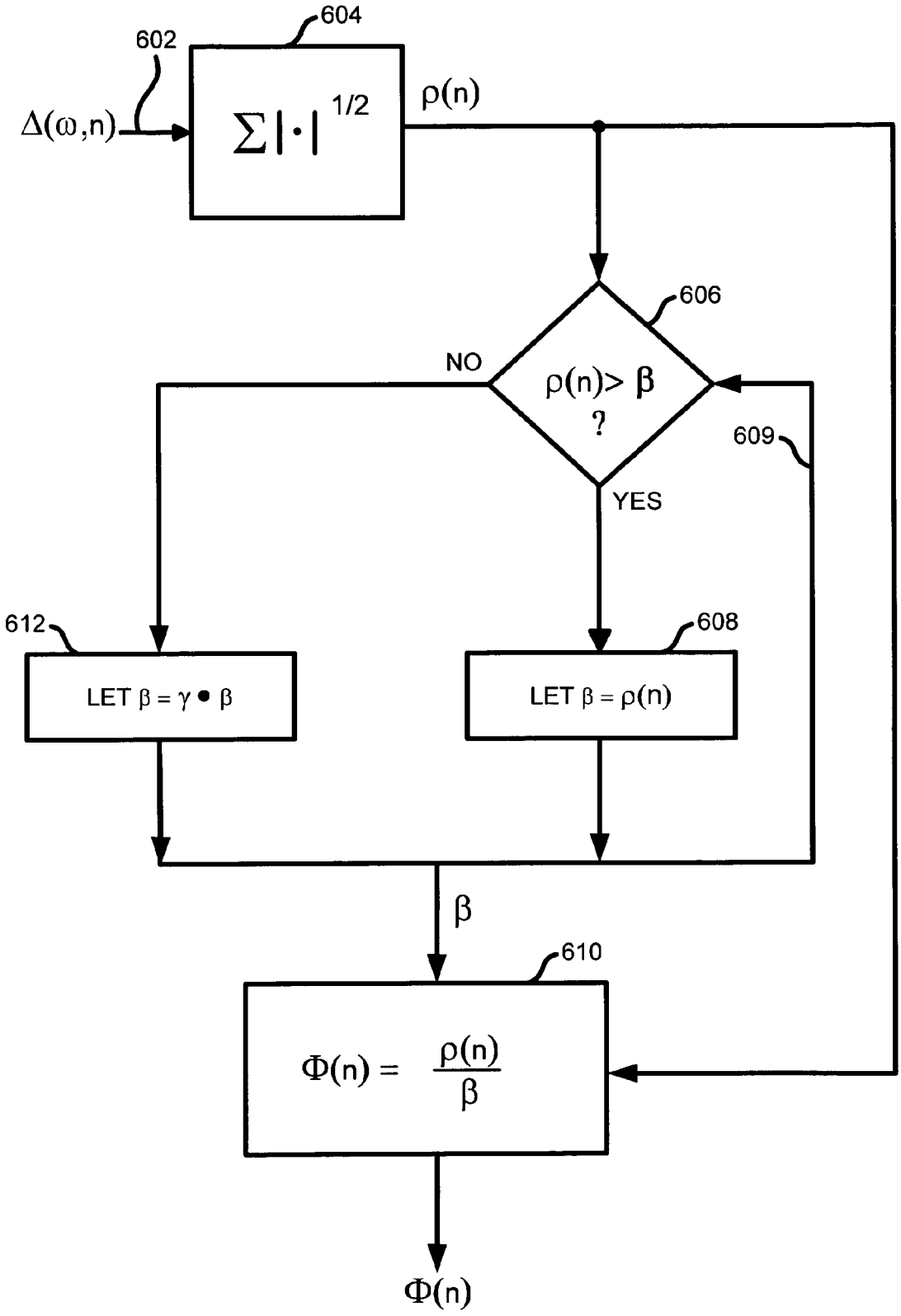
FIG. 6 is a block diagram illustrating an approach used in one embodiment to calculate normalized spectral flux, such as in block 424 of FIG. 4 and step 510 of the process shown in FIG. 5.

FIG. 6 is a block diagram illustrating an approach used in one embodiment to calculate normalized spectral flux, such as in block 424 of FIG. 4 and step 510 of the process shown in FIG. 5. Difference values Δ(ω, n) are provided via a line 602 to a spectral flux calculation block 604. In one embodiment, as noted above, the spectral flux ρ(n) is defined as the sum of the square root of the difference values associated with a particular frame "n" of the audio signal. Other definitions and/or methods of calculating spectral flux may be used in other embodiments. The output ρ(n) of block 604 is provided to a scaling factor comparison block 606 configured to compare the spectral flux ρ(n) calculated for the frame "n" currently under analysis with a normalization scaling factor β. If the block 606 determines that the current spectral flux ρ(n) is greater than the current value of the normalization scaling factor β, that result causes the scaling factor β to be reset to the value of the spectral flux ρ(n) for the current frame "n" in a block 608, and the newly set scaling factor is provided to the normalized spectral flux determination block 610. If the block 606 determines that the current spectral flux ρ(n) is not greater in value than the current value of the normalization scaling factor, then in block 612 the normalization scaling factor is reduced in value by setting the scaling factor to a new value equal to the old value multiplied by a time decay factor γ. In one embodiment, the normalization scaling factor is gradually reduced in value over time by operation of block 612 so that the normalized spectral flux values will not be dependent on the signal level of the incoming audio signal. As shown in FIG. 6, the updated normalization scaling factor β is provided either by block 608 or by block 612 to the normalized spectral flux determination block 610. The newly set scaling factor is provided as well to the block 606 to update the value of the scaling factor β for use in processing the next frame of audio data by block 606, as indicated by the line 609. In one embodiment, the block 610 is configured to calculate the normalized spectral flux by dividing the flux ρ(n) determined by the block 604 by the scaling factor β to yield a normalized spectral flux value Φ(n). While the embodiment described in connection with FIG. 6 uses a scaling factor to calculate a normalized spectral flux, in other embodiments contemplated by this disclosure, the raw spectral flux data may also be used. In addition, normalization schemes other than those described in detail above may be used.

Figure 7A:
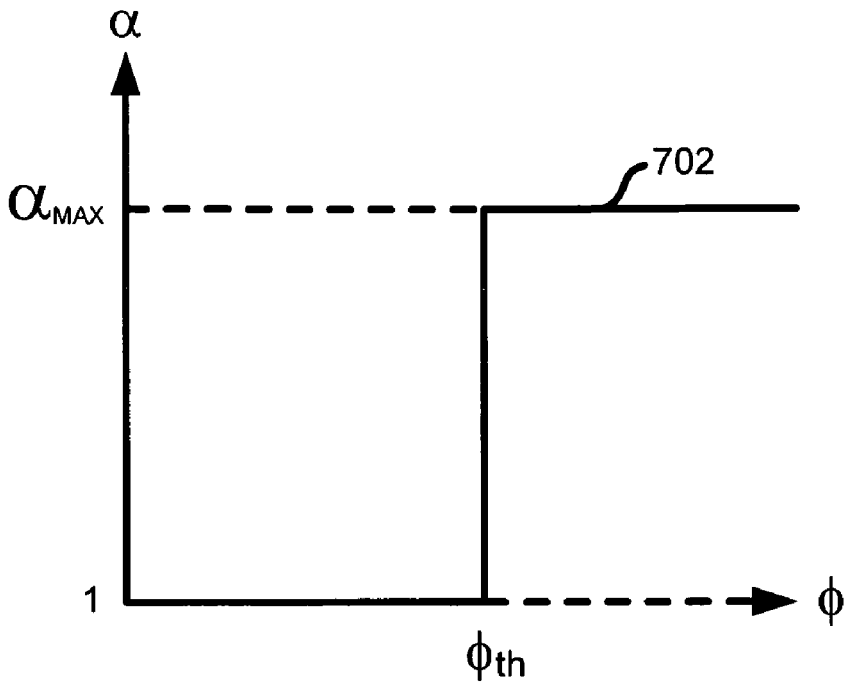
FIG. 7A illustrates for comparison purposes a method for detecting and determining an un-graded (i.e., binary) response to a transient audio event.

FIG. 7A illustrates for comparison purposes a method for detecting and determining an un-graded (i.e., binary) response to a transient audio event. The graph shown in FIG. 7A has the normalized flux Φ on the horizontal axis and a modification factor α on the vertical axis. In the example shown in FIG. 7A, the modification factor α ranges in value from a minimum value of 1 to a maximum value $\alpha_{MAX}$. The step function 702 shown in FIG. 7A would result in the value of α(n) being set to 1 for all values of normalized spectral flux Φ(n) that are less than a threshold value $\Phi_{th}$, such that frames of audio data for which the normalized spectral flux is less than the threshold normalized spectral flux would not be modified. By comparison, for frames of audio data having a normalized spectral flux greater than or equal to the threshold normalized spectral flux $\Phi_{th}$, the modification factor α(n) would be set to the maximum value $\alpha_{MAX}$, such that audio frames having a normalized spectral flux equal to or greater than the threshold level would receive the maximum modification (i.e., enhancement or suppression, as appropriate). In one embodiment, a binary approach such as that shown in FIG. 7A is used to detect transient audio events and the modification factor α(n) is used to apply a nonlinear modification to the portion of the audio signal in which a transient audio event is detected.

Figure 7B:
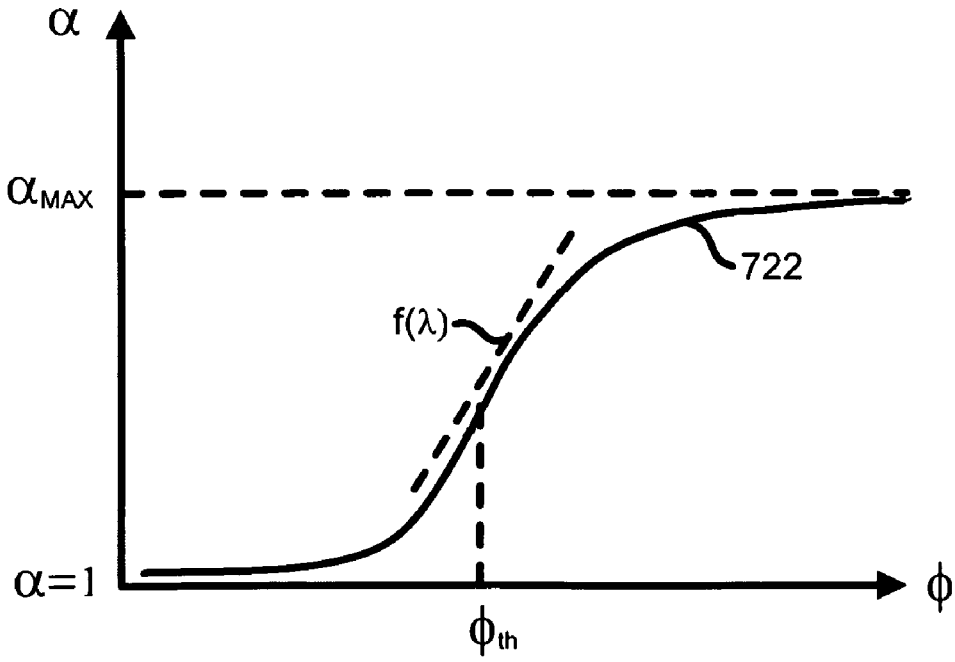
FIG. 7B illustrates a method for determining a modification factor that provides a graded response to a detected transient audio event.

The binary approach illustrated in FIG. 7A and described above, which one might describe as corresponding to a "hard decision" being made as to whether or not a transient audio event has been detected, may result in undesirable audible artifacts, including for instance an undesirable "pumping" effect. FIG. 7B illustrates a method for determining a modification factor that provides a graded response to a detected transient audio event. Referring to the curve 722 shown in FIG. 7B, for frames of audio data having a normalized spectral flux $\Phi(n)$ significantly less than the threshold normalized spectral flux $\Phi_{th}$, the value of the modification factor $\alpha(n)$ approaches, and in one embodiment may come to equal the minimum value of $\alpha=1$. While in the example shown for purposes of illustration in FIG. 7B the minimum value for $\alpha(n)$ is $\alpha=1$, in other embodiments the minimum value may be something other than one, such as zero or a negative number, depending on the implementation and the particular equation used to apply the modification factor $\alpha$ to the audio signal. As the normalized spectral flux $\Phi(n)$ for an audio frame "n" approaches the threshold normalized spectral flux $\Phi_{th}$, as shown in FIG. 7B the corresponding value of the modification factor $\alpha(n)$ begins to increase to a value that is greater than the minimum value of $\alpha=1$, but initially at least still significantly less than the maximum value $\alpha_{MAX}$. For frames of audio data having a corresponding normalized spectral flux equal to or greater than the threshold value $\Phi_{th}$, the corresponding modification factor $\alpha(n)$ increases in value and eventually approaches, and in one embodiment it may come to equal, the maximum value $\alpha_{MAX}$. The particular curve illustrated in FIG. 7B illustrates a hyperbolic tangent function used in one embodiment to calculate a modification factor $\alpha$ to be used to provide a graded response to detected transient audio events. In one embodiment the curve shown in FIG. 7B is determined by the following equation:

$$\alpha(n) = \frac{(\alpha_{\mathrm{MAX}} + 1)}{2} + \frac{(\alpha_{\mathrm{MAX}} - 1)}{2}\tanh[\pi\lambda(\Phi(n) - \Phi_{th})] \quad [1]$$

where $\alpha(n)$ is the modification factor determined for a particular frame of audio data, $\alpha_{MAX}$ is the maximum value possible for the modification factor $\alpha$, $\lambda$ determines the slope of the tangent to the curve 722 at the point corresponding to the threshold normalized spectral flux $\Phi_{th}$ (i.e., A determines how steep or shallow the curve is and thereby determines the extent to which audio data frames having normalized spectral flux values that are significantly less or significantly more than the threshold normalized spectral flux $\Phi_{th}$ are modified), $\Phi(n)$ is the normalized spectral flux value for the particular frame "n" of audio data being analyzed and/or modified, and $\Phi_{th}$ is the threshold value for the normalized spectral flux (e.g., in one embodiment $\Phi_{th}$ is the midpoint of the range of normalized spectral flux values for which the modification factor $\alpha$ is a value greater than the minimum value of $\alpha=1$ but less than a maximum value of $\alpha=\alpha_{MAX}$). The shape and dimensions of the curve 722 of FIG. 7B, therefore, are determined by the values $\alpha_{MAX}$, $\lambda$, and $\Phi_{th}$. In one embodiment, these values may be determined in advance by a sound designer and may remain fixed regardless of the incoming audio signal and/or the listener. In one alternative embodiment, one or more of the values $\alpha_{MAX}$, $\lambda$, and $\Phi_{th}$ may be varied. In one embodiment, one or more of said values may be varied based on one or more parameters and/or characteristics of the incoming audio signal. In one embodiment, one or more said variables may be varied and/or controlled by a user by adjusting a user control provided on a user interface as described more fully below in connection with FIGS. 10-12. While the above discussion and example shown in FIG. 7B refer to a hyperbolic tangent function, any other function or waveform that provides a graded response based at least in part on spectral flux may be used. For example, and without limitation, a linear response or curve may be used, or a nonlinear response or curve other than a hyperbolic tangent function may be used. Likewise, a piecewise linear approximation of a nonlinear response or curve, such as a piecewise linear approximation of a hyperbolic tangent function, may be used. In addition, a non-continuous method of mapping the normalized spectral flux (or other quantification of a transient audio event), such as a look-up table, may be used.

By using a graded response curve such as the curve 722 of FIG. 7B, the modification factor $\alpha$ applied to any particular frame of audio data may be varied in proportion to the magnitude of the normalized spectral flux for that frame of audio data. As will become more apparent through the below discussion of the modification of frames of audio data using the modification factors $\alpha$, varying the value of the modification factor $\alpha$ in proportion to the magnitude of the normalized spectral flux $\Phi$ provides for a graded response to detected transient audio events, because portions of the audio signal containing more significant transient audio events (i.e., portions that have a higher normalized spectral flux value than other portions) will be modified to a greater extent than portions of the audio signal containing less significant transient audio events. It has been found that providing such a graded response provides a much more pleasing listening experience than determining the modification factor $\alpha$ in a binary manner, such as is illustrated in FIG. 7A, which would result in less significant transient audio events receiving no modification and all transient audio events in frames of audio data having a normalized spectral flux $\Phi(n)$ greater than the threshold normalized spectral flux receiving the same degree of modification regardless of their relative magnitude and/or significance. As noted above, such a binary approach may result in an unpleasing listening experience due to artifacts, such as audio "pumping".

Figure 7C:
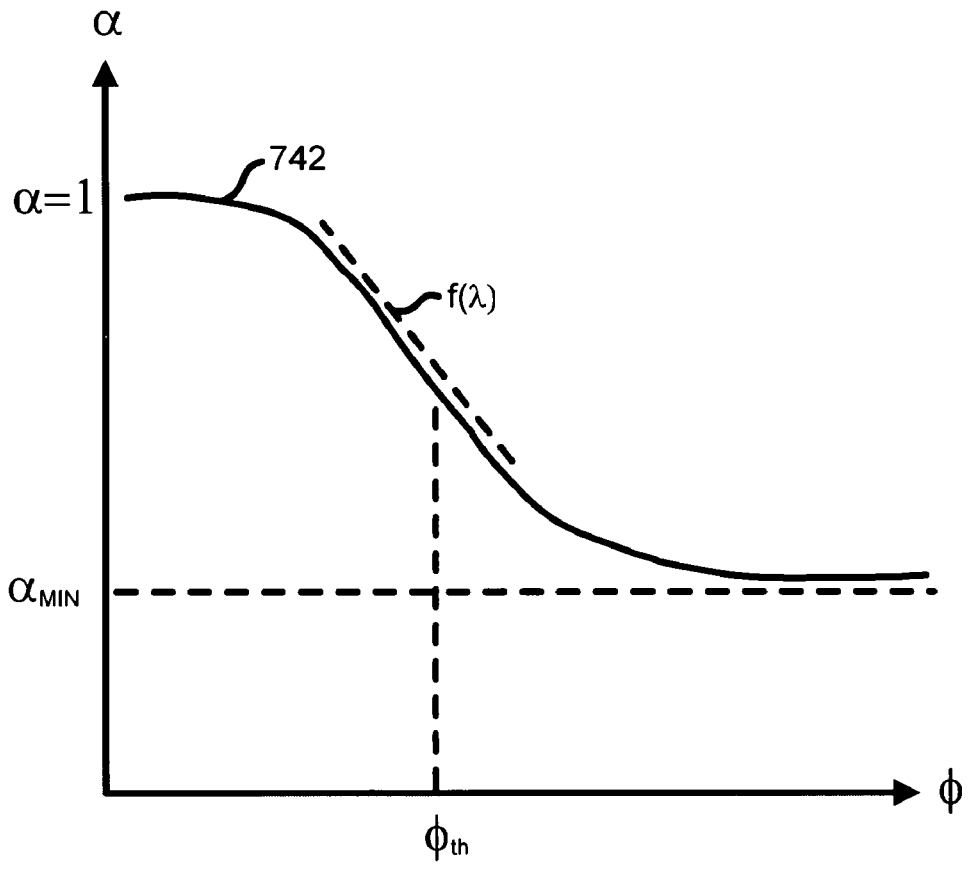
FIG. 7C shows a curve used in one embodiment to determine the value of the modification factor $\alpha$ where suppression or smoothing of transient audio events is desired.

In one embodiment, the curve shown in FIG. 7B is used to determine the modification factor $\alpha$ where enhancement, as opposed to suppression or smoothing, of transient audio events is desired. In one embodiment, the curve 742 shown in FIG. 7C is used to determine the value of the modification factor $\alpha$ where suppression or smoothing of transient audio events is desired. As shown in FIG. 7C, the curve is essentially the mirror image of the curve 722 of FIG. 7B about the horizontal line $\alpha=1$.

The curve 742 has a maximum value of $\alpha=1$, and the value of the modification factor gradually decreases as the normalized spectral flux $\Phi(n)$ approaches the threshold value $\Phi_{th}$. As the normalized spectral flux increases and begins to be much greater than the threshold, the modification factor approaches a minimum value $\alpha_{MIN}$. In one embodiment, the minimum value $\alpha_{MIN}$ may be any value greater than or equal to zero and less than or equal to one. In one embodiment, the equation for the curve shown in FIG. 7C may be determined by substituting the variable $\alpha_{MIN}$ for the variable $\alpha_{MAX}$ in Equation [1] above.

Figure 8:
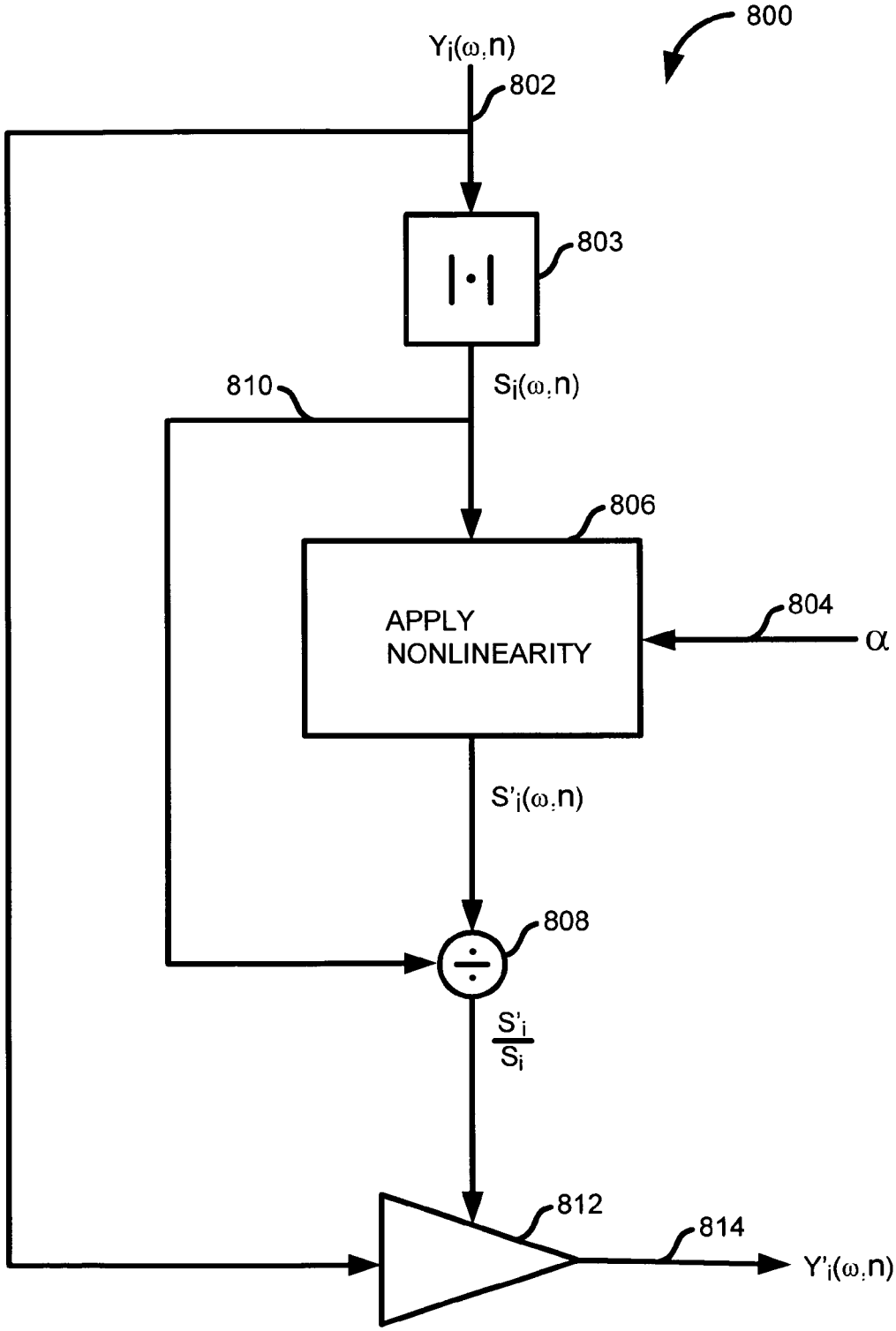
FIG. 8 is a block diagram of a system used in one embodiment to apply a nonlinear modification to a portion of an audio signal in which a transient audio event has been detected, as in step 106 of the process shown in FIG. 1, block 208 of the system block diagram shown in FIG. 2, and step 310 of the process shown in FIG. 3.

FIG. 8 is a block diagram of a system used in one embodiment to apply a nonlinear modification to a portion of an audio signal in which a transient audio event has been detected, as in step 106 of the process shown in FIG. 1, block 208 of the system block diagram shown in FIG. 2, and step 310 of the process shown in FIG. 3. The signal modification block 800 receives on line 802 a series of STFT results $Y_i(\omega, n)$ for successive frames "n" of an incoming audio signal y(t) as described above. In one embodiment, the audio signal y(t) comprises a plurality of channels, and the subscript "i" in the notation "$Y_i(\omega, n)$" indicates the STFT results for a particular channel "i" of the signal y(t). In one such embodiment, modification of the audio signal is performed channel by channel, such that a nonlinear signal modification block such as signal modification block 800 is provided for each channel. The STFT results $Y_i(\omega, n)$ are provided to a spectral magnitude determination block 803 configured to determine the spectral magnitude values $S_i(\omega, n)$ for the corresponding STFT results for frame "n" and channel "i". The modification block 800 also receives as an input on line 804 a modification factor $\alpha$, determined in one embodiment as described above in connection with FIG. 7B or FIG. 7C, as appropriate. The modification block 800 comprises an apply nonlinearity sub-block 806, which is configured to receive the modification factor $\alpha$ and the spectral magnitude values $S_i(\omega, n)$ as inputs. As shown in FIG. 8, the apply nonlinearity sub-block 806 is configured to provide as output a series of modified spectral magnitude values $S_i'(\omega, n)$. In one embodiment, the apply nonlinearity sub-block 806 is configured to calculate a modified spectral magnitude value $S_i'(\omega, n)$ for each frame "n" by using the corresponding value of the modification factor $\alpha(n)$ to calculate a nonlinear modification of the value $S_i(\omega, n)$. In one embodiment, the nonlinear modification is determined in accordance with the following equation:

$$S'(\omega,n)=[S(\omega,n)+1]^{\alpha(n)}-1 \quad [2]$$

In one embodiment, the above equation [2] is used to insure that for values of the modification factor $\alpha$ greater than 1 the modified spectral magnitude value $S'(\omega, n)$ will always be greater than the corresponding unmodified spectral magnitude value $S(\omega, n)$ even if $S(\omega, n)$ is less than 1. In such an embodiment, the value of a greater than 1 will always result in enhancement of a transient audio event (such as may be desired by a listener who prefers sharper transients), see, e.g., FIG. 7B. Conversely equation [2] will always result in a reduction or de-emphasis of transient audio events for values of the modification factor $\alpha$ between zero and 1, regardless of the value of $S(\omega, n)$, such as may be desired by a listener who prefers smoother transients (i.e., a listening experience in which transient audio events are smoothed out and/or otherwise de-emphasized); see, e.g., FIG. 7C. In other embodiments, equations other than equation [2] may be used to apply the modification factor $\alpha$ to modify a transient audio event. For example, and without limitation, linear expansion or compression of the signal (e.g., multiplying the magnitudes $S(\omega, n)$ by the modification factor $\alpha$) or simple nonlinear expansion or compression of the signal (e.g., raising the magnitudes $S(\omega, n)$ to the exponent $\alpha$), or any variation on and/or combination of the two, may be used.

Referring further to FIG. 8, the apply nonlinearity sub-block 806 is configured to provide the modified spectral magnitude values $S_i'(\omega, n)$ to a division sub-block 808. The division sub-block 808 is also configured to receive as an input on line 810 the unmodified spectral magnitude values $S_i(\omega, n)$, and to calculate for each frame "n" a modification ratio $S_i'(\omega, n)$ divided by $S_i(\omega, n)$. The modification ratio calculated by division sub-block 808 is provided as an input to amplifier 812. The amplifier 812 also receives for each frame of the audio signal the STFT result $Y_i(\omega, n)$. The amplifier 812 is configured to multiply the STFT result $Y_i(\omega, n)$ for each frame "n" by its corresponding modification ratio $S_i'(\omega, n)/S_i(\omega, n)$ determined by division sub-block 808 to provide as output on line 814 a modified STFT result $Y'_i(\omega, n)$ for each successive frame "n" of channel "i". In one embodiment, calculating a modified spectral value $S_i'(\omega, n)$ and using that value to determine the modification ratio by operation of a division sub-block such as division sub-block 808, and then applying that modification ratio to the STFT result $Y_i(\omega, n)$, enables the modification ratio to be calculated and a modified STFT value to be determined in a manner that preserves the phase information embodied in the STFT results $Y_i(\omega, n)$. While FIG. 8 illustrates an embodiment in which the modification ratio and modified STFT result are determined on a per channel basis, in one alternative embodiment the modification ratio may be determined based on a combined signal and then applied to each channel.

Figure 9A:
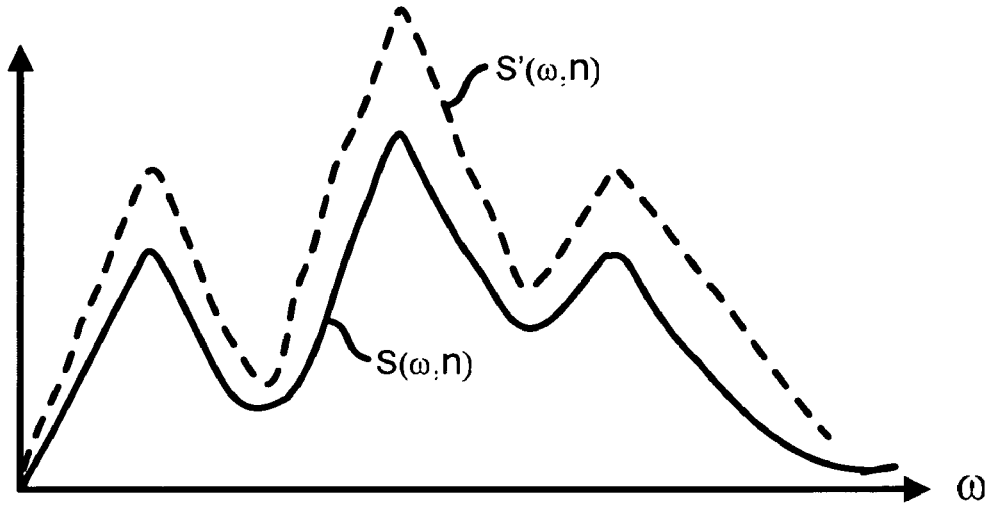
FIG. 9A shows a plot of an illustrative example of an unmodified set of spectral magnitude values $S(\omega, n)$ compared to the corresponding modified spectral magnitude values $S'(\omega, n)$.
Figure 9B:
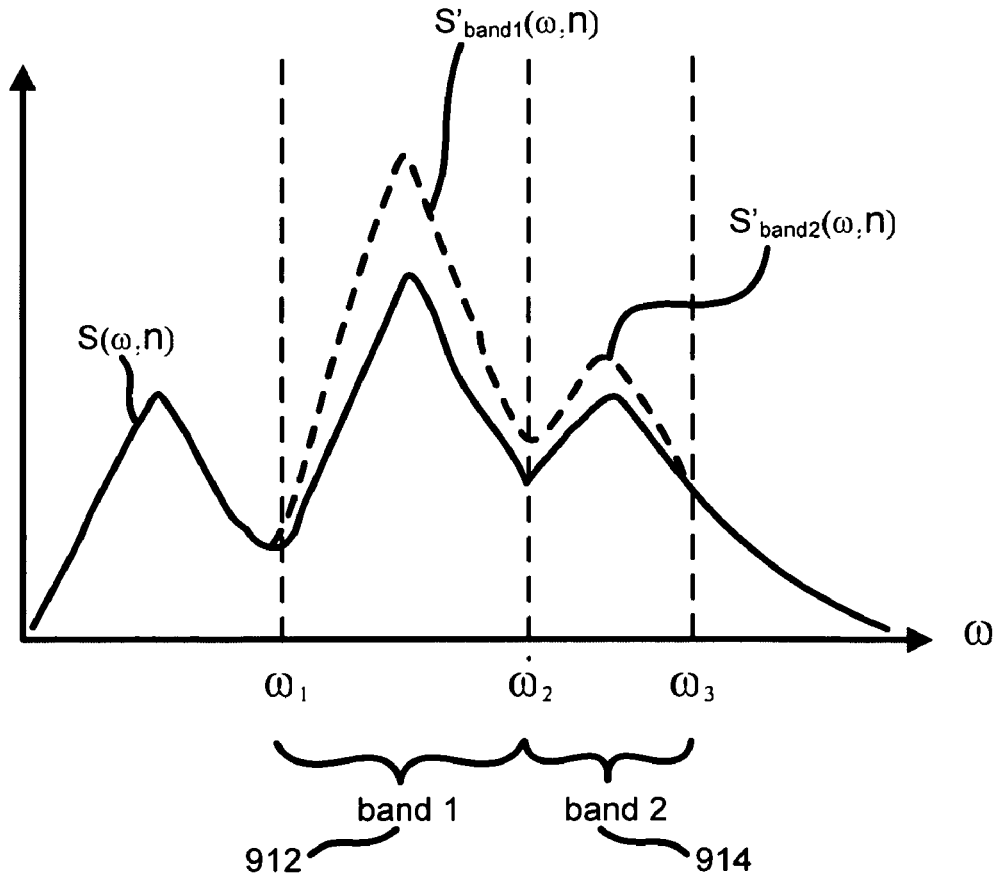
FIG. 9B illustrates an alternative approach used in one embodiment to modify the spectral magnitude $S(\omega, n)$ only in one or more frequency bands.

FIG. 9A shows a plot of an illustrative example of an unmodified set of spectral magnitude values $S(\omega, n)$ compared to the corresponding modified spectral magnitude values $S'(\omega, n)$. In the graph shown in FIG. 9A the frequency $\omega$ is on the horizontal axis and the spectral magnitude S is plotted on the vertical axis. In the example shown in FIG. 9A, the spectral magnitudes $S(\omega, n)$ have been modified across the entire frequency spectrum. FIG. 9B illustrates an alternative approach used in one embodiment to modify the spectral magnitude $S(\omega, n)$ only in one or more frequency bands. In the particular example illustrated in FIG. 9B, the unmodified spectral value plot $S(\omega, n)$ is the same as the corresponding plot $S(\omega, n)$ shown in FIG. 9A. However, in FIG. 9B, a first band 912 and a second band 914 have been defined. The first band 912 has a lower limit $\omega_1$ and an upper limit $\omega_2$ and the second band 914 has a lower limit $\omega_2$ and an upper limit $\omega_3$. For portions of the spectral magnitude curve $S(\omega, n)$ lying to the left of the lower limit of the first band 912, i.e., for frequencies less than $\omega_1$, no modification is applied to the spectral magnitudes. Likewise, for portions of the curve $S(\omega, n)$ that lie to the right of the upper frequency limit of the second frequency band 914, i.e. for frequencies greater than $\omega_3$, no modification is applied. Within the first frequency band 912 a first level of modification has been applied to generate a first set of modified spectral magnitude values $S_{band1}'(\omega, n)$ within said first frequency band 912. Similarly, a second modification factor has been applied to the spectral magnitude values corresponding to the second frequency band 914 to generate a second set of modified spectral magnitude values $S_{band2}'(\omega, n)$ for frequencies in the second frequency band 914. In one embodiment, the second degree of modification may be greater than, equal to, or less than the first degree of modification applied within the first frequency band 912, in order to make it possible to provide different levels or degrees of modification for different frequency bands. Providing such functionality makes it possible, for example, to provide greater or lesser emphasis (or de-emphasis as applicable) in different frequency ranges to transient audio events. For example, a listener may desire to more greatly emphasize transient audio events that occur in a frequency range associated with a favored musical instrument while at the same time providing less emphasis, or in one embodiment even de-emphasizing, transient audio events that occur in other frequency ranges, such as in the frequency range normally associated with the human voice. Other listeners may simply have a preference for emphasizing transient audio events more strongly in higher frequency bands than in lower frequency bands, or vice versa, without regard to associating such frequency bands with any particular instrument or source of audio data. In one embodiment, transient audio events are detected within each frequency band and the signal modified accordingly within the frequency band in which a transient is detected. In one such embodiment, detection of transient audio events within each frequency band is performed by computing a normalized spectral flux for each separate band using elements such as those illustrated in FIGS. 4A, 4B, and 6. In one alternative embodiment, transient audio events are for simplicity detected across the full frequency spectrum (e.g., in one embodiment spectral flux and/or normalized spectral flux are calculated across the full spectrum), but the modification of the spectral magnitude occurs differently in different frequency bands. In one embodiment, different modification is provided for different frequency bands by providing a separate curve or function, such as illustrated in FIGS. 7B and/or 7C, as appropriate, for each frequency band. In one embodiment, as described above, different values or levels of modification for different bands may be determined by having one or more of the maximum modification factor $\alpha_{MAX}$, the slope parameter $\lambda$ and/or the threshold normalized spectral flux $\Phi_{th}$ be different for the different frequency bands. In one alternative embodiment, the values of $\alpha_{MAX}$, $\lambda$, and $\Phi_{th}$ may be the same for each frequency band, but the equation used to apply in a nonlinear manner the modification factor $\alpha$ may be different for different frequency bands, such as by multiplying the modification factor $\alpha$ in equation [2] above by a variable scaling factor to either increase or reduce, as desired, the extent of the nonlinear modification for a given frequency band.

In one embodiment, the size and location within the frequency spectrum of the one or more frequency bands, such as the first and second frequency bands 912 and 914 of FIG. 9B, are determined in advance by a sound engineer and are fixed for a given system. In one alternative embodiment, one or more parameters defining the one or more frequency bands may be varied. In one embodiment, a user may control one or more parameters that determine the frequency bands, as described more fully below. For example, in one embodiment, a user may determine the values for $\omega_1$, $\omega_2$, and $\omega_3$ in the example shown in FIG. 9B. In other embodiments, the one or more frequency bands may be controlled in other manners, such as by a push button or other control enabling or disabling modification in a particular frequency band and/or a control allowing the extent of modification within a fixed frequency band to be adjusted.

Figure 10A:
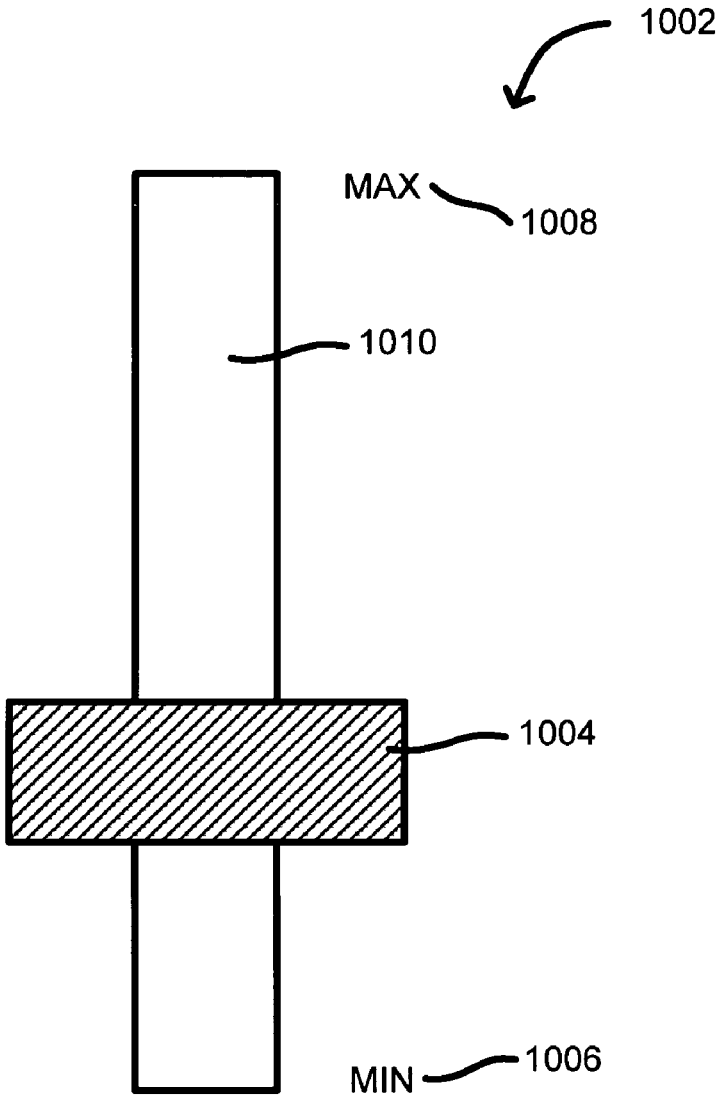
FIG. 10A shows a user control 1002 provided in one embodiment to enable a user to control the detection and modification of transient audio events.

FIG. 10A shows a user control 1002 provided in one embodiment to enable a user to control the detection and modification of transient audio events. As shown in FIG. 10A the user control 1002 comprises a slider control having a modification level indicator 1004 configured to enable a user to position the level indicator 1004 between a minimum value 1006 and a maximum value 1008 along a slider 1010. In one embodiment, a control such as control 1002 may be provided to enable a user to control the extent to which transient audio events are either enhanced or suppressed. For example, in one embodiment, the control 1002 may be configured to enable a user to select between a minimum degree of enhancement of transient audio events corresponding to the minimum level 1006 and a maximum value corresponding to maximum level 1008. In one embodiment, the system is configured to be responsive to input from the user control 1002 to adjust one or more of the factors described above as influencing and/or determining the extent of modification of transient audio events. For example, in one embodiment, the minimum position 1006 of the control 1002 corresponds to a maximum value for the normalized spectral flux $\Phi_{th}$, a minimum value for the slope parameter $\lambda$, and a minimum value for the maximum modification factor $\alpha_{MAX}$. In one embodiment in which the control 1002 is configured to influence the modification of the audio signal differently in different frequency bands, the minimum level 1006 may, for example, correspond to more narrow (or more broad) frequency bands and/or frequency bands in a lower (or higher) frequency range, as determined by a sound engineer. As noted above, in one embodiment in which the modification is performed differently in different frequency bands, the frequency bands themselves are fixed and in such an embodiment the control 1002 of FIG. 10A would not influence or change the frequency bands themselves. Conversely, the maximum value 1008 of the control 1002 of FIG. 10A may correspond in one embodiment to a minimum possible value for the threshold normalized spectral flux $\Phi_{th}$, a maximum value for the slope parameter $\lambda$, and a maximum value for the maximum modification factor $\alpha_{MAX}$. In a multiple frequency band embodiment, the maximum position 1008 corresponds in one embodiment to, for example, more wide (or more narrow) frequency bands and/or frequency bands in a higher (or lower) frequency range, as determined by a sound designer. In one embodiment, intermediate positions between the minimum level 1006 and the maximum level 1008 are determined by employing a sound designer to determine one or more set points between the minimum and maximum values. Such a sound designer may choose intermediate set point values for the threshold normalized spectral flux $\Phi_{th}$, the slope parameter $\lambda$, and/or the maximum modification factor $\alpha_{MAX}$, and in applicable embodiments the frequency band edges, to achieve a pleasing listening experience at each set point between the minimum and maximum values, with set points nearer to the minimum value in one embodiment being characterized by less modification of transient audio events than set points nearer to the maximum position 1008 of the control 1002. Once a sound designer has selected one or more set points between the minimum and maximum positions, intermediate values for the normalized spectral flux $\Phi_{th}$, the slope parameter $\lambda$, and/or the maximum modification factor $\alpha_{MAX}$ corresponding to positions between the set points or between a set point and the minimum and maximum positions 1006 and 1008 respectively may be determined using known interpolation techniques. In one embodiment, the interpolation of the underlying values for the normalized spectral flux $\Phi_{th}$, the slope parameter $\lambda$, and/or the maximum modification factor $\alpha_{MAX}$ corresponding to positions between set points may be either linear or nonlinear, as may be determined to be most appropriate given the set of set points designed by the sound designer.

The control 1002 shown in FIG. 10A may be used either to control the enhancement or to control the suppression of transient audio events. In the case of suppression, the minimum value 1006 may correspond to a maximum modification factor AMAX (i.e., no modification is provided). For example, in an embodiment in which equation [2] above is used, for a suppression control using a control of the type shown in FIG. 10A in one embodiment the minimum value 1006 may correspond to a maximum modification factor $\alpha_{MAX}=1$, which would result in $S'(\omega, n)=S(\omega, n)$. Conversely, for a transient suppression control the maximum position 1008 would correspond in one embodiment, for example, to a modification factor $\alpha$ equal to a minimum modification factor $\alpha_{MIN}$, which in the extreme case could be equal to 0 in an embodiment in which equation [2] above is used (i.e. $S'(\omega, n)=0$, or complete suppression of the spectral magnitude for a frame of audio data in which a very significant transient audio event has been detected).

Figure 10B:
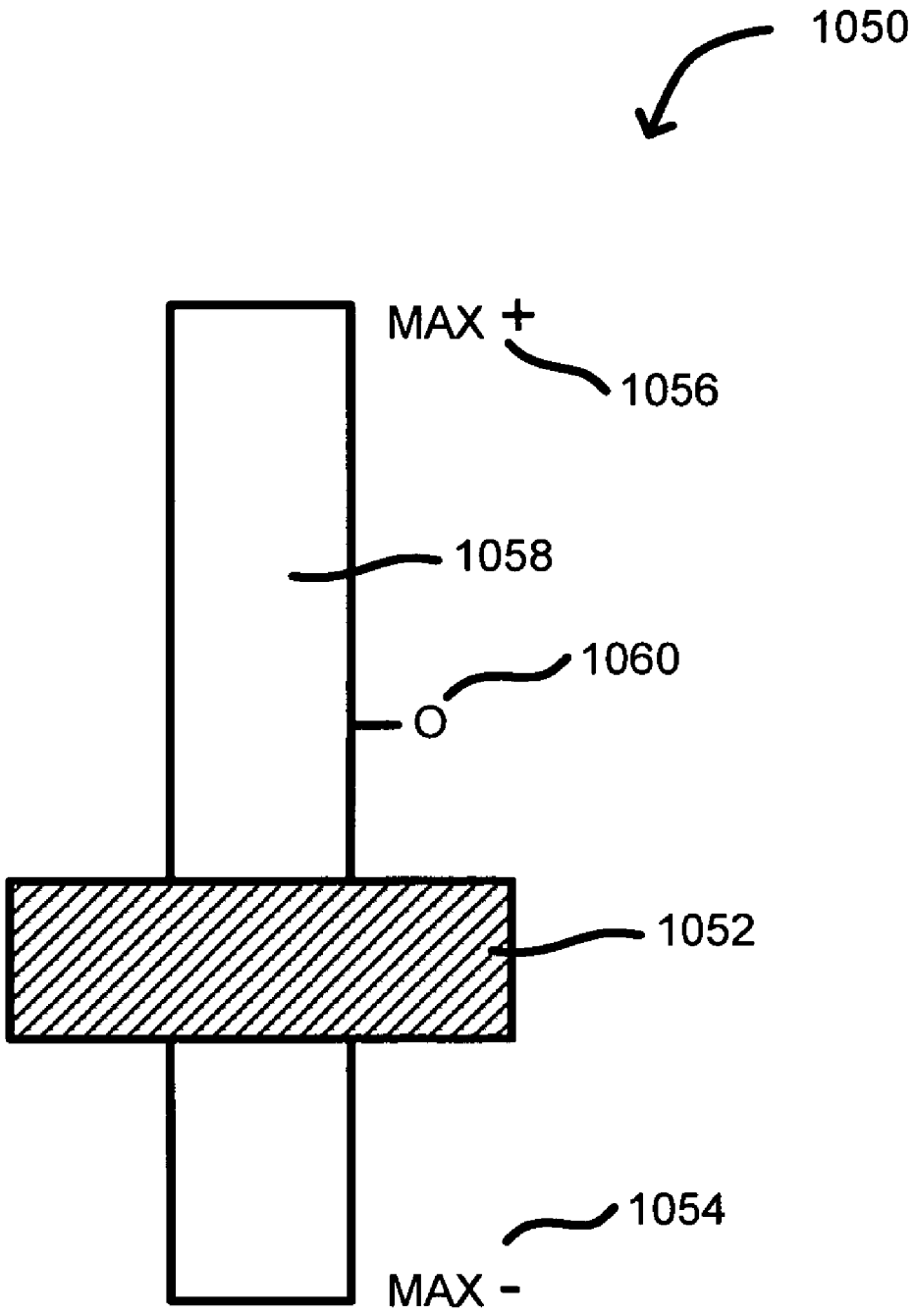
FIG. 10B illustrates an alternative control 1050 comprising a level indicator 1052 configured to be positioned along a slider 1058 between a maximum negative value 1054 and a maximum positive value 1056.

FIG. 10B illustrates an alternative control 1050 comprising a level indicator 1052 configured to be positioned along a slider 1058 between a maximum negative value 1054 and a maximum positive value 1056. A center or null value 1060 along the slider 1058 in one embodiment corresponds to no enhancement or suppression of detected transient audio events. In one embodiment, the maximum negative position 1054 corresponds to a maximum level of suppression of transient audio events and the maximum positive position 1056 corresponds to a maximum degree of enhancement of transient audio events. In one embodiment, the portion of slider 1058 between the null point 1060 and the maximum positive modification 1056 operates essentially in the same manner as the control 1002 of FIG. 10A, as described above for control of enhancement of transient audio events. In one embodiment, the operation of control 1050 in the range of slider 1058 between the null point 1060 and the maximum negative point 1054 corresponds to the operation of control 1002 of FIG. 10A as used for the control of suppression of transient audio events as described above. In one embodiment, the null point 1060 of FIG. 10B corresponds to a point in which the modification factor $\alpha=1$, the maximum positive value point 1056 corresponds to a maximum modification factor $\alpha_{MAX}>1$, and the maximum negative point 1054 along slider 1058 corresponds to a minimum modification factor $\alpha_{MIN}$, where $0\leqq\alpha_{MIN}<1$.

Figure 11:
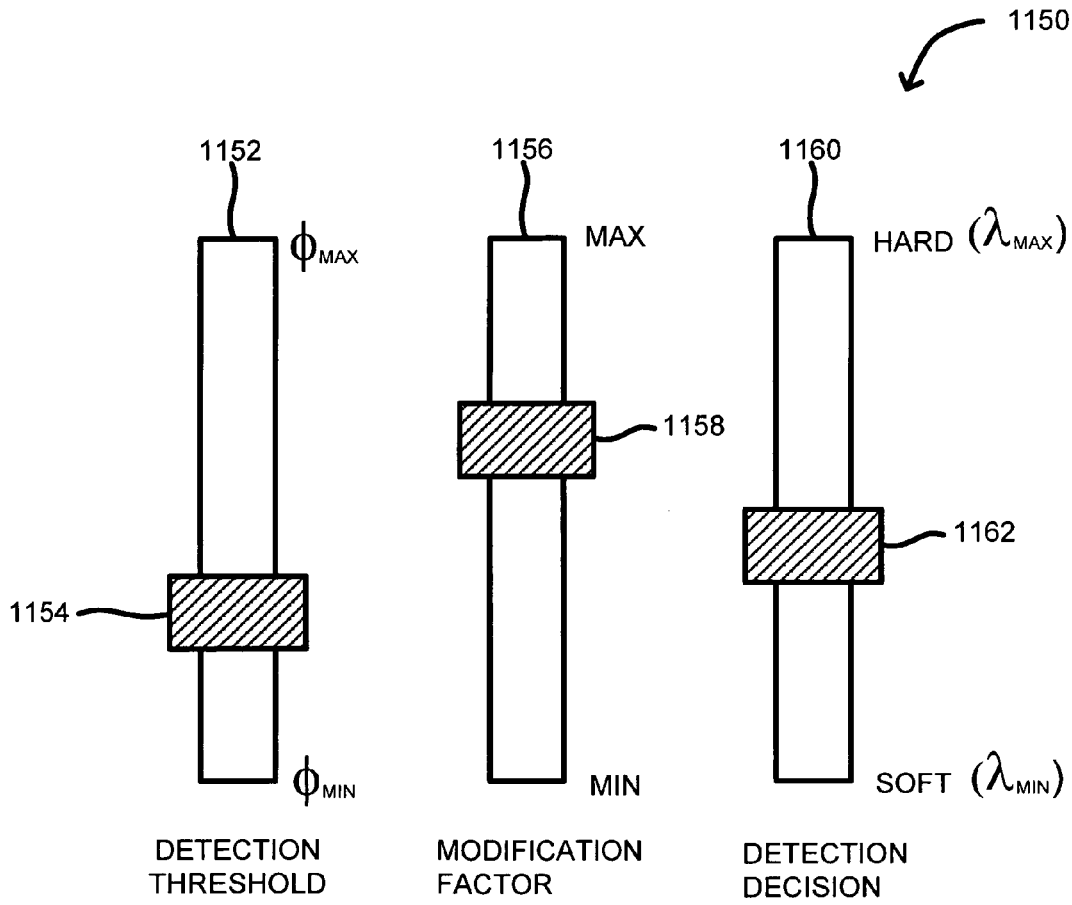
FIG. 11 illustrates a set of controls 1150 used in one embodiment to enable a user to control directly the values of the variables $\alpha_{MAX}$ (or $\alpha_{MIN}$ in the case of suppression/smoothing), $\lambda$, and $\Phi_{th}$.

FIG. 11 illustrates a set of controls 1150 used in one embodiment to enable a user to control directly the values of the variables $\alpha_{MAX}$ (or $\alpha_{MIN}$ in the case of suppression/smoothing), $\lambda$, and $\Phi_{th}$. The set of controls 1150 comprises a detection threshold slider 1152 and an associated threshold flux level indicator 1154. The threshold flux level indicator 1154 may be used in one embodiment to indicate a desired value for the threshold normalized flux $\Phi_{th}$. The set of controls 1150 further comprises a modification factor slider 1156 and an associated modification factor level indicator 1158. The modification factor level indicator 1158 may be used in one embodiment to indicate a desired value for the maximum modification factor $\alpha_{MAX}$ (or a minimum modification factor $\alpha_{MIN}$ in the case of smoothing or suppression). The set of controls 1150 further comprises a detection decision type slider 1160 and an associated detection decision type level indicator 1162. The detection decision type level indicator 1162 may be used in one embodiment to indicate a desired value for the slope parameter $\lambda$. In one embodiment, the higher the setting indicated by the detection decision type level indicator 1162, the steeper the slope (i.e., the closer the curve such as shown in FIG. 7B or FIG. 7C, as applicable, is to the "hard decision" illustrated in FIG. 7A and discussed above).

Figure 12:
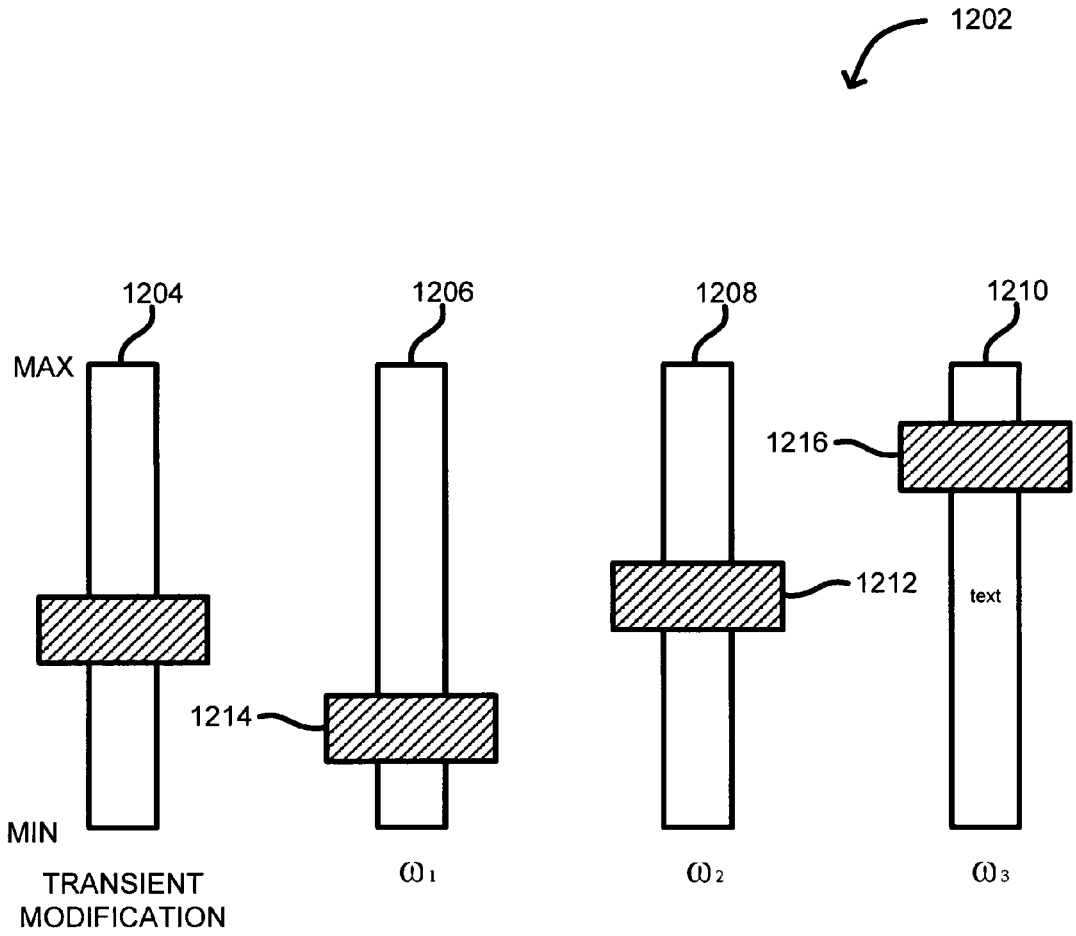
FIG. 12 illustrates a set of controls 1202 comprising a transient control 1204 of the type illustrated in FIG. 10A, for example.

FIG. 12 illustrates a set of controls 1202 comprising a transient control 1204 of the type illustrated in FIG. 10A, for example. The set of controls 1202 further comprises a set of frequency set point slider controls 1206, 1208, and 1210. In one embodiment slider controls 1206, 1208, and 1210 are configured to allow a user to control the frequency bands within which modification occurs by allowing a user to determine the frequencies that correspond to $\omega_1$, $\omega_2$, and $\omega_3$, as shown in FIG. 9B. In one embodiment, the slider controls 1206, 1208, and 1210 are configured so that the indicator 1212 of the slider control 1208 is always in a position equal to or greater than the position of the indicator 1214 of slider control 1206, and likewise the indicator 1216 of the slider control 1210 is always in a position equal to or greater than that of the indicator 1212 of the slider control 1208, so that the slider controls 1206, 1208, and 1210 always define a low, middle, and high frequency set point, respectively to define the two frequency bands within which modification can occur. While the control 1202 shown in FIG. 12 indicates three frequency band edges, obviously any number of such edges may be provided for, depending on the number of different frequency bands within which the system is configured to provide differing levels of modification of detected transient audio events. Also, while the set of controls 1202 shown in FIG. 12 shows a single control 1204 for controlling the enhancement, in the case of the example shown in FIG. 12, of transient audio events, any number of other different controls may be provided in a particular embodiment, such as providing a separate control such as control 1204 for each of the two frequency bands defined by the slider controls 1206, 1208, and 1210; providing for each frequency band a set of controls such as those illustrated in FIG. 11; and/or providing one or more further or different controls for modification of transient audio events other than enhancement (e.g., suppression), either collectively or within individual frequency bands, as desired in a particular implementation.

While the controls shown in FIGS. 10A-12 are slider controls, it should be understood that any other type of control may be used to control the parameters shown in FIGS. 10A-12 and described above in the same or similar manner as described in connection with FIGS. 10A-12.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. A method for modifying an audio signal, comprising:

obtaining an audio signal; calculating a degree of transientness in a first portion of the audio signal by using a processor; and modifying the first portion of the audio signal to an extent based at least in part on the degree of transientness calculated, wherein calculating the degree of transientness comprises using a hyperbolic tangent function to calculate a modification factor, wherein the modification factor is determined for a particular frame of audio data.

2. The method of claim 1, wherein calculating the degree of transientness comprises calculating a degree of change between said first portion of said audio signal and a second portion of said audio signal.

3. The method of claim 2, wherein calculating the degree of change comprises calculating a degree of spectral change.

4. The method of claim 1, wherein calculating the degree of transientness comprises calculating a normalized spectral flux value associated with said first portion of the audio signal, including: calculating a spectral flux value for said first portion of the audio signal; and dividing said spectral flux value for said first portion of the audio signal by a normalization factor.

5. The method of claim 4, wherein calculating the spectral flux value comprises processing said audio signal using a subband filter bank.

6. The method of claim 5, wherein processing said audio signal using a subband filter bank comprises determining the Fourier transform for at least a first and second frame of the audio signal wherein said first portion of the audio signal includes the first frame.

7. The method of claim 6, wherein calculating the spectral flux value further comprises filtering at least a first value associated with the Fourier transform of the first frame and a second value associated with the Fourier transform of the second frame.

8. The method of claim 7, wherein: the first value and the second value include the magnitudes of the Fourier transform of the first frame and second frame, respectively; and filtering comprises high-pass filtering the magnitudes of the Fourier transform of the first frame and second frame.

9. The method of claim 8, wherein high-pass filtering comprises calculating a difference between the magnitudes of the Fourier transform of the first frame and second frame.

10. The method of claim 8, wherein calculating the spectral flux value further comprises summing a square root of the filtered magnitudes for a given frame across the frequency spectrum.

11. The method of claim 1, wherein: modifying said first portion of the audio signal comprises nonlinear modification of said first portion of said audio signal; and said nonlinear modification comprises: determining a spectral magnitude of said first portion of the audio signal; and applying a nonlinear modification to said spectral magnitude of said first portion of the audio signal to yield a modified spectral magnitude.

12. The method of claim 11, wherein applying the nonlinear modification to said spectral magnitude of said first portion of the audio signal comprises raising said spectral magnitude to an exponent.

13. The method of claim 11, wherein applying the nonlinear modification to said spectral magnitude of said first portion of the audio signal comprises: adding one to said spectral magnitude of said first portion of the audio signal to obtain a first intermediate result; raising said first intermediate result to an exponent to obtain a second intermediate result; and subtracting one from said second intermediate result to obtain said modified spectral magnitude.

14. The method of claim 1, wherein calculating the degree of transientness and modifying the signal in accordance with the degree of transientness comprises calculating a first degree of transientness for a first frequency band and modifying said first portion of the audio signal within said first frequency band in accordance with said first degree of transientness.

15. A system for modifying an audio signal, comprising: an interface configured to obtain an audio signal; a transient analysis module configured to calculate a degree of transientness in a first portion of the audio signal by using a processor; and a modification module configured to modify the first portion of the audio signal to an extent based at least in part on the degree of transientness calculated, wherein calculating the degree of transientness comprises using a hyperbolic tangent function to calculate a modification factor, wherein the modification factor is determined for a particular frame of audio data.

16. The system of claim 14, wherein the transient analysis module is configured to calculate the degree of transientness by calculating a normalized spectral flux associated with said first portion of the audio signal, including by: calculating a spectral flux value for said first portion of the audio signal; and dividing said spectral flux value for said first portion of the audio signal by a normalization factor.

17. A computer program product for modifying an audio signal, the computer program product being embedded in a non-transitory computer-readable medium and comprising computer instructions for: obtaining an audio signal; calculating a degree oftransientness in a first portion of the audio signal by using a processor; and modifying the first portion of the audio signal to an extent based at least in part on the degree of transientness calculated, wherein calculating the degree of transientness comprises using a hyperbolic tangent function to calculate a modification factor, wherein the modification factor is determined for a particular frame of audio data.

18. The computer program product of claim 17, wherein said computer instructions for calculating the degree of transientness include computer instructions for calculating a normalized spectral flux value associated with said first portion of the audio signal, including: computer instructions for calculating a spectral flux value for said first portion of the audio signal; and computer instructions for dividing said spectral flux value for said first portion of the audio signal by a normalization factor.

19. A method for modifying an audio signal, comprising: detecting a transient audio event in a first portion of the audio signal; determining a graded response to the detected transient audio event by using a processor; and modifying said first portion of the audio signal in accordance with the graded response; wherein calculating the degree of transientness comprises using a hyperbolic tangent function to calculate a modification factor, wherein the modification factor is determined for a particular frame of audio data, wherein detecting a transient audio event comprises calculating a normalized spectral flux value associated with said first portion of the audio, signal, including: calculating a spectral flux value for said first portion of the audio signal; and dividing said spectral flux value for said first portion of the audio signal by normalization factor.

* * * * *